US009486999B2

(12) United States Patent
Moriwaki et al.

(10) Patent No.: US 9,486,999 B2
(45) Date of Patent: Nov. 8, 2016

(54) IMAGE FORMING APPARATUS

(71) Applicants: Yuta Moriwaki, Kanagawa (JP); Hiroshi Sawase, Kanagawa (JP)

(72) Inventors: Yuta Moriwaki, Kanagawa (JP); Hiroshi Sawase, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/934,427

(22) Filed: Nov. 6, 2015

(65) Prior Publication Data

US 2016/0129693 A1 May 12, 2016

(30) Foreign Application Priority Data

Nov. 7, 2014 (JP) ..... 2014-226697

(51) Int. Cl.
*B41J 2/045* (2006.01)
*B41J 2/165* (2006.01)

(52) U.S. Cl.
CPC ..... *B41J 2/04586* (2013.01); *B41J 2/0454* (2013.01); *B41J 2/1652* (2013.01); *B41J 2/16508* (2013.01); *B41J 2/16523* (2013.01); *B41J 2002/16573* (2013.01)

(58) Field of Classification Search
CPC ..... B41J 2/04563; B41J 2/04528; B41J 2/04598; B41J 2/0454; B41J 2/0458; B41J 2/04573; B41J 2/2135; B41J 2/2132; B41J 2/04586; B41J 2/16508; B41J 2/1652; B41J 2/16523; B41J 2002/16573
See application file for complete search history.

(56) References Cited

U.S. PATENT DOCUMENTS 6,634,735 B1 * 10/2003 Silverbrook ..... B41J 2/04528 347/17
2010/0321424 A1 * 12/2010 Tamaki ..... B41J 2/055 347/6
2012/0154476 A1 6/2012 Doi et al.
2013/0033536 A1 2/2013 Sawase
2013/0194346 A1 8/2013 Moriwaki
2013/0222460 A1 8/2013 Sawase
2014/0009531 A1 1/2014 Kaneko et al.
2014/0063121 A1 3/2014 Moriwaki et al.

(Continued)

FOREIGN PATENT DOCUMENTS

JP 2007-090654 4/2007
JP 2008-188838 8/2008
JP 2009-023329 2/2009

(Continued)

*Primary Examiner* — Thinh Nguyen
(74) *Attorney, Agent, or Firm* — Cooper & Dunham LLP

(57) ABSTRACT

An image forming apparatus includes a liquid discharge head, a temperature detector, a memory, and a controller. The temperature detector detects a temperature of the liquid discharge head. The memory stores the temperature of the liquid discharge head detected with the temperature detector. The controller controls a bubble purge operation to purge bubbles in the liquid discharge head. When a current temperature of the liquid discharge head acquired by the temperature detector is higher than a stored temperature stored in the memory and a deviation of the acquired current temperature and the stored temperature is equal to or more than a predefined threshold value, the controller executes control to execute the bubble purge operation, and when the current temperature acquired by the temperature detector is lower than the stored temperature, the controller executes control to update the stored temperature stored and retained in the memory with the acquired current temperature.

14 Claims, 10 Drawing Sheets

(56) References Cited

U.S. PATENT DOCUMENTS

| | | | |
|---|---|---|---|
| 2014/0152745 | A1 | 6/2014 | Park et al. |
| 2014/0265106 | A1 | 9/2014 | Saitoh et al. |
| 2015/0077478 | A1 | 3/2015 | Kawabata et al. |
| 2015/0306878 | A1 | 10/2015 | Sawase et al. |

FOREIGN PATENT DOCUMENTS

| | | |
|---|---|---|
| JP | 2011-082836 | 3/2011 |
| JP | 2011-104932 | 6/2011 |
| JP | 2012-210817 | 11/2012 |
| JP | 2013-202993 | 10/2013 |

* cited by examiner

IMAGE FORMING APPARATUS

CROSS-REFERENCE TO RELATED APPLICATION

This patent application is based on and claims priority pursuant to 35 U.S.C. §119(a) to Japanese Patent Application No. 2014-226697, filed on Nov. 7, 2014, in the Japan Patent Office, the entire disclosure of which is hereby incorporated by reference herein.

BACKGROUND

1. Technical Field

Aspects of the present disclosure relate to an image forming apparatus.

2. Related Art

In a liquid discharge head to discharge droplets, bubbles mixed into the head may cause a discharge failure. As the temperature of liquid increases, the amount of gas (the volume of air) soluble in the liquid decreases. Accordingly, as the liquid discharge head changes from a low temperature to a high temperature, air dissolved in liquid may appear as bubbles, thus causing a discharge failure.

SUMMARY

In an aspect of the present disclosure, there is provided an image forming apparatus that includes a liquid discharge head, a temperature detector, a memory, and a controller. The liquid discharge head discharges a droplet. The temperature detector detects a temperature of the liquid discharge head. The memory stores the temperature of the liquid discharge head detected with the temperature detector. The controller controls a bubble purge operation to purge bubbles in the liquid discharge head. When a current temperature of the liquid discharge head acquired by the temperature detector is higher than a stored temperature stored in the memory and a deviation of the acquired current temperature and the stored temperature is equal to or more than a predefined threshold value, the controller executes control to execute the bubble purge operation, and when the current temperature acquired by the temperature detector is lower than the stored temperature, the controller executes control to update the stored temperature stored and retained in the memory with the acquired current temperature.

In an aspect of the present disclosure, there is provided an image forming apparatus that includes a liquid discharge head, a temperature detector, a memory, and a controller. The liquid discharge head discharges a droplet. The temperature detector detects a temperature of the liquid discharge head. The memory stores the temperature of the liquid discharge head detected with the temperature detector. The controller controls a bubble purge operation to purge bubbles in the liquid discharge head. When a current temperature acquired by the temperature detector is equal to or higher than a threshold temperature stored and retained in the memory, the controller executes control to execute the bubble purge operation and when the current temperature acquired by the temperature detector is a temperature lower than a predetermined temperature with respect to the threshold temperature, the controller executes control to update the threshold temperature stored and retained in the memory with a temperature obtained by adding the predetermined temperature to the acquired current temperature.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
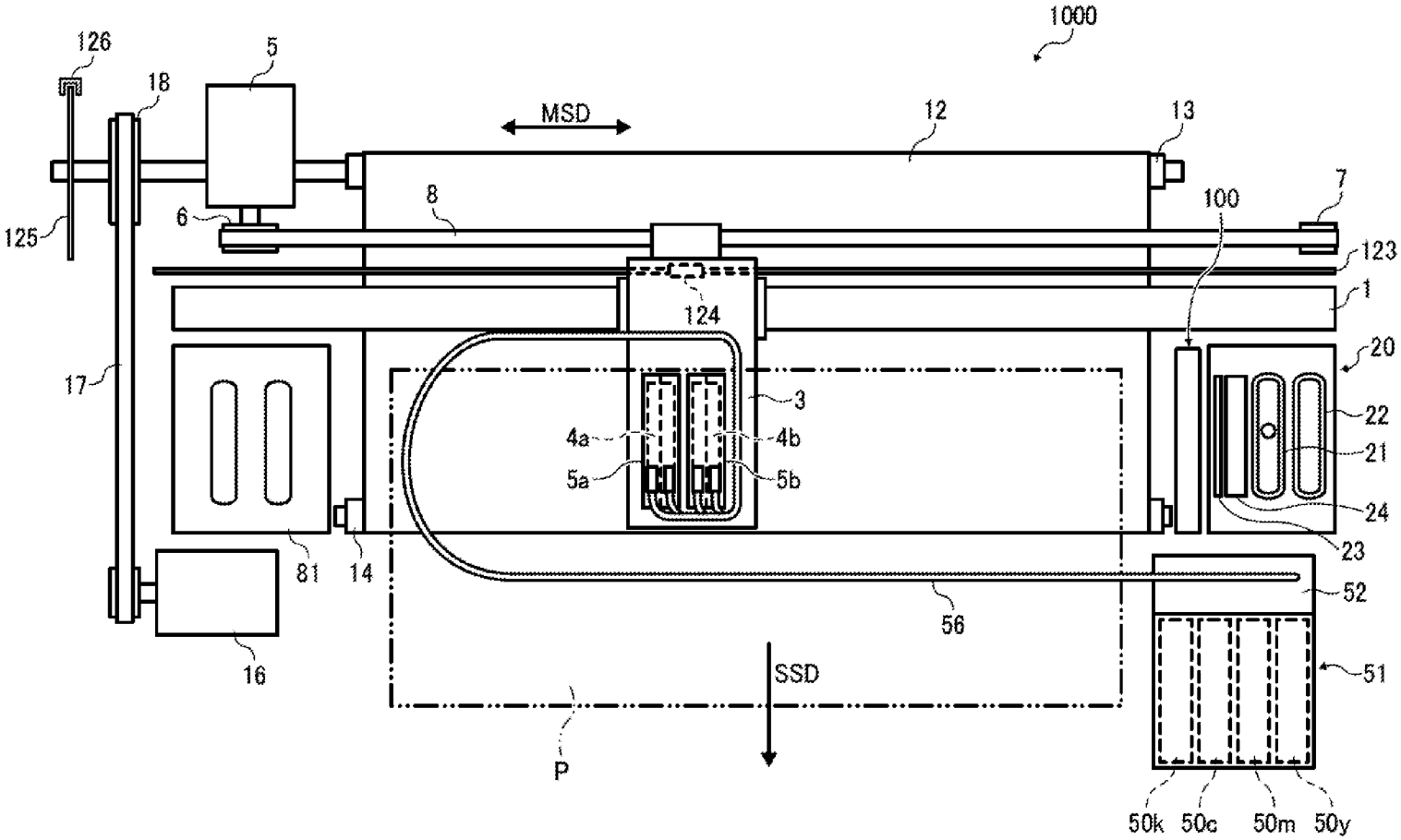
FIG. 1 is a plan view of an example of a mechanical section of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components)

having the same function or shape and redundant descriptions thereof are omitted below.

First, an example of an image forming apparatus according to an embodiment of this disclosure is described with reference to FIG. 1.

Figure 2:
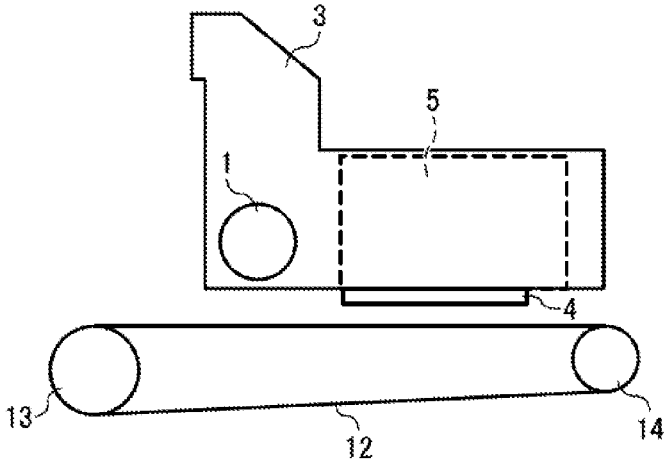
FIG. 2 is a side view of a portion of the image forming apparatus of FIG. 1.
Figure 3:
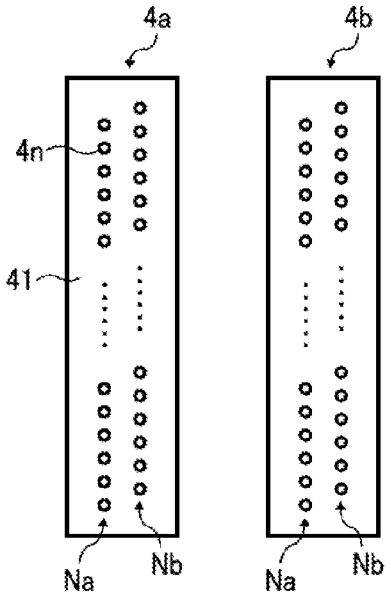
FIG. 3 is a plan view of a configuration of recording heads of the mechanical section.

FIG. 1 is a plan view of a mechanical section of an image forming apparatus according to an embodiment of this disclosure. FIG. 2 is a partial side view of the mechanical section of FIG. 1. FIG. 3 is a plan view of a configuration of recording heads of the mechanical section. FIG. 3 a transparent view of the recording heads seen from above.

The image forming apparatus 1000 is a serial-type inkjet recording apparatus. A carriage 3 is supported by a main guide rod 1 and a sub guide rod so as to be movable in a direction (main scanning direction) indicated by arrow MSD in FIG. 1. The main guide rod 1 and the sub guide rod are laterally bridged between left and right side plates. A main scanning motor 15 reciprocally moves the carriage 3 for scanning in the main scanning direction (carriage movement direction) MSD via a timing belt 8 laterally bridged between a driving pulley 6 and a driven pulley 7.

The carriage 3 mounts recording heads 4*a* and 4*b* constituted of liquid discharge heads serving as image forming devices and head tanks 5*a* and 5*b* to supply liquid to the recording heads 4*a* and 4*b*.

As illustrated in FIG. 3, each of the recording heads 4*a* and 4*b* (referred to as "recording heads 4" unless specified) includes two nozzle rows Na and Nb. The nozzle rows Na and Nb are arranged in a staggered manner to be offset from each other with respect to a nozzle array direction in which multiple nozzles 4*n* are arrayed in each of the nozzle rows Na and Nb.

For example, one nozzle row Na of the recording head 4*a* discharges droplets of black (K) and the other nozzle row Nb discharges droplets of cyan (C). One nozzle row Na of the recording head 4*b* discharges droplets of magenta (M) and the other nozzle row Nb discharges droplets of yellow (Y).

In some embodiments, as the recording head 4, a recording head is used that has a nozzle face of one recording head (liquid discharge head) in which multiple nozzle rows, each including multiple nozzles, are arrayed to discharge droplets of respective colors.

As a liquid discharge head constituting the recording head 4, in some embodiments, a piezoelectric actuator such as a piezoelectric element, a thermal actuator utilizing phase change generated by film boiling of a liquid with an electrothermal conversion element such as a heat generating resistant body, or the like is used.

The head tanks 5*a* and 5*b* are paired tanks corresponding to the two nozzle rows Na and Nb of each of the recording heads 4*a* and 4*b*. That is, the carriage 3 includes multiple head tanks.

A cartridge holder 51 is disposed at an apparatus body of the image forming apparatus 1000. Main tanks (liquid cartridges) 50 (50*y*, 50*m*, 50*c*, and 50*k*) to contain liquid of the respective colors are removably mounted to the cartridge holder 51.

The cartridge holder 51 includes a liquid feed pump unit 52 to supply liquid of the respective colors from the main tanks 50 to the head tanks 5*a* and 5*b* via supply tubes (also referred to as liquid supply passages) 36 for the respective colors.

To convey a sheet P, the image forming apparatus 1000 also includes a conveyance belt 12 serving as a conveyor to attract the sheet P thereon and convey the sheet P to a position opposing the recording heads 4. The conveyance belt 12 is an endless belt wound around a conveyance roller 13 and a tension roller 14.

The conveyance roller 13 is rotated by a sub scanning motor 16 via a timing belt 17 and a timing pulley 18, so that the conveyance belt 12 circulates in a sub-scanning direction indicated by arrow SSD in FIG. 1. A charging roller charges (i.e., applies charges to) the conveyance belt 12 in circulation. Alternatively, in some embodiments, a suction device sucks the sheet P onto the conveyance belt 12.

In FIG. 1, the image forming apparatus 1000 further includes a maintenance-and-recovery device 20 serving as one of a recovery device to maintain and recovery the recording heads 4 and a first dummy discharge receptacle 81 to receive droplets discharged during dummy discharge in which droplets not contributing to image formation are discharged from the recording heads 4. The maintenance-and-recovery device 20 is disposed at a lateral side of the conveyance belt 12 on one side in the main scanning direction MSD of the carriage 3. The first dummy discharge receptacle 81 is disposed at a lateral side of conveyance belt 12 on the opposite side in the main scanning direction MSD.

The maintenance-and-recovery device 20 includes, for example, a suction cap 21 and a moisture-retention cap 22 to cap a nozzle face 41 of any one of the recording heads 4, a wiper 23 to wipe the nozzle faces 41 of the recording heads 4, and a second dummy discharge receptacle 24 to receive liquid droplets not contributing to image formation and discharged from the recording heads 4.

The image forming apparatus 1000 further includes a discharge sensor unit 100 to sense a discharge state, i.e., whether droplet discharge is being performed. The discharge sensor unit 100 is disposed at an area outside a recording region between the conveyance belt 12 and the maintenance-and-recovery device 20 to oppose the recording heads 4.

Note that, the discharge sensor unit 100 includes an electrode plate in a configuration in which the discharge sensor unit 100 constitutes a discharge sensing device to sense the presence/absence of droplet discharge by detecting electric change due to landing of droplets on the electrode plate. Alternatively, in a configuration in which the discharge sensor unit 100 constitutes a discharge sensing device to sense the presence/absence of droplet discharge by laser beam.

An encoder scale 123 with a predetermined pattern is bridged along the main scanning direction MSD between the side plates, and the carriage 3 mounts an encoder sensor 124 constituted of a transmissive photosensor to read the pattern of the encoder scale 123. The encoder scale 123 and the encoder sensor 124 constitute a linear encoder (main scanning encoder) to sense movement of the carriage 3.

A code wheel 125 is mounted on a shaft of the conveyance roller 13, and an encoder sensor 126 constituted of a transmissive photosensor is disposed to detect a pattern of the code wheel 125. The code wheel 125 and the encoder sensor 126 constitute a rotary encoder (sub-scanning encoder) to detect the movement amount and position of the conveyance belt 12.

In the image forming apparatus 1000 thus configured, a sheet P is fed and attracted onto the conveyance belt 12 charged with the charging roller. With the sheet P attracted on the conveyance belt 12, the conveyance belt 12 is circulated to convey the sheet P in the sub-scanning direction SSD.

By driving the recording heads 4 in accordance with image signals while moving the carriage 3, liquid droplets are discharged onto the sheet P, which is stopped below the recording heads 4, to form one line of a desired image. Then, the sheet P is fed by a predetermined distance to prepare for the next operation to record another line of the image.

Receiving a recording end signal or a signal indicating that the rear end of the sheet P has arrived at the recording region, the recording operation finishes and the sheet P is output to a sheet ejection tray.

Figure 4:
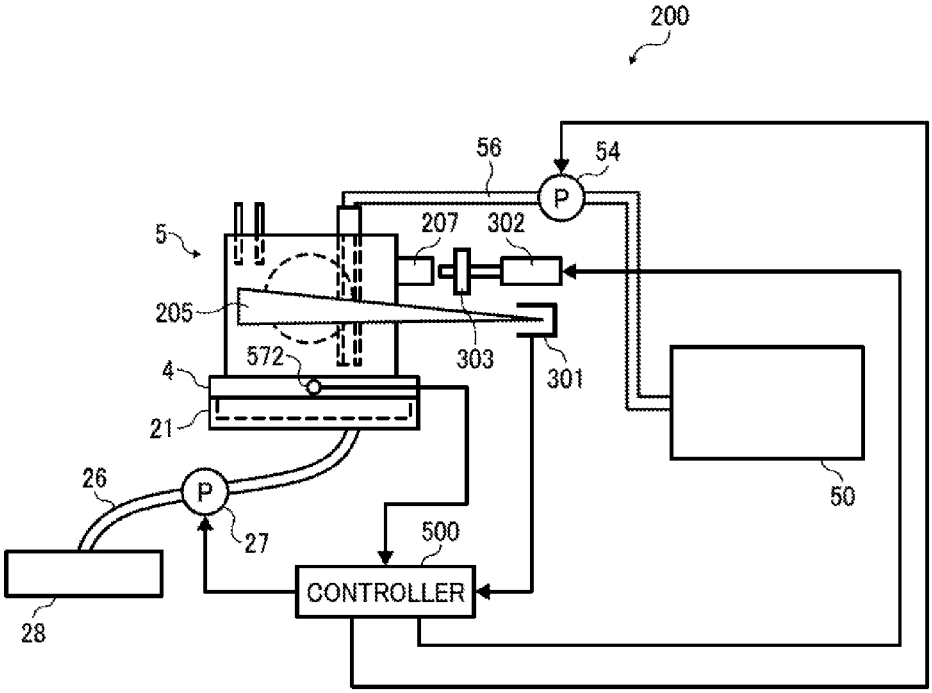
FIG. 4 is a schematic view of a liquid supply-and-drain system of the image forming apparatus.

Next, a liquid supply-and-drain system of the image forming apparatus according to this embodiment is described with reference to FIG. 4. FIG. 4 is a schematic view of a liquid supply-and-drain system 200 in this embodiment.

In the liquid supply-and-drain system 200, a liquid feed pump 54 serving as a liquid feeder supplies liquid from a main tank 50 to a head tank 5 via a supply tube 56.

The liquid feed pump 54 is a reversible pump (reversible liquid feeder) constituted of, e.g., a tube pump, capable of performing normal feed operation to supply liquid from the main tank 50 to the head tank 5 and reverse feed operation to return liquid from the head tank 5 to the main tank 50.

The liquid supply-and-drain system 200 includes a suction cap 21 to cap a nozzle face 41 of any one of the recording heads 4 and a suction pump 27 connected to the suction cap 21. The suction pump 27 is driven with the nozzle face 41 capped with the suction cap 21 to suck liquid from the nozzles via a suction tube 26, thus allowing liquid to be sucked from the head tank 5 and the recording head 4. Waste liquid sucked from the head tank 5 is drained to a waste liquid tank 28.

The head tank 5 has an air releaser 207 openable and closable to release the interior of the head tank 5 to ambient atmosphere. An release actuator 303 and an air release solenoid 302 are disposed at the apparatus body. The release actuator 303 actuates the air releaser 207 of the head tank 5 to open. The air release solenoid 302 moves the release actuator 303. By actuating the air release solenoid 302, the air releaser 207 can be opened.

The head tank 5 includes a displacement member 205 to displace according to the amount of liquid remaining in the head tank 5. A feeler sensor 301 is disposed at the apparatus body to sense the displacement member 205. According to detection results of the feeler sensor 301, the maintenance-and-recovery device 20 performs liquid feed control on the head tank 5 in a state in which the head tank 5 is open to the ambient atmosphere.

The liquid supply-and-drain system 200 further includes a temperature sensor 572 serving as a temperature detector to detect the temperature (head temperature) of the recording heads 4.

Note that, a controller 500 controls of driving of the liquid feed pump 54, the air release solenoid 302, the suction pump 27, and so on.

Figure 5:
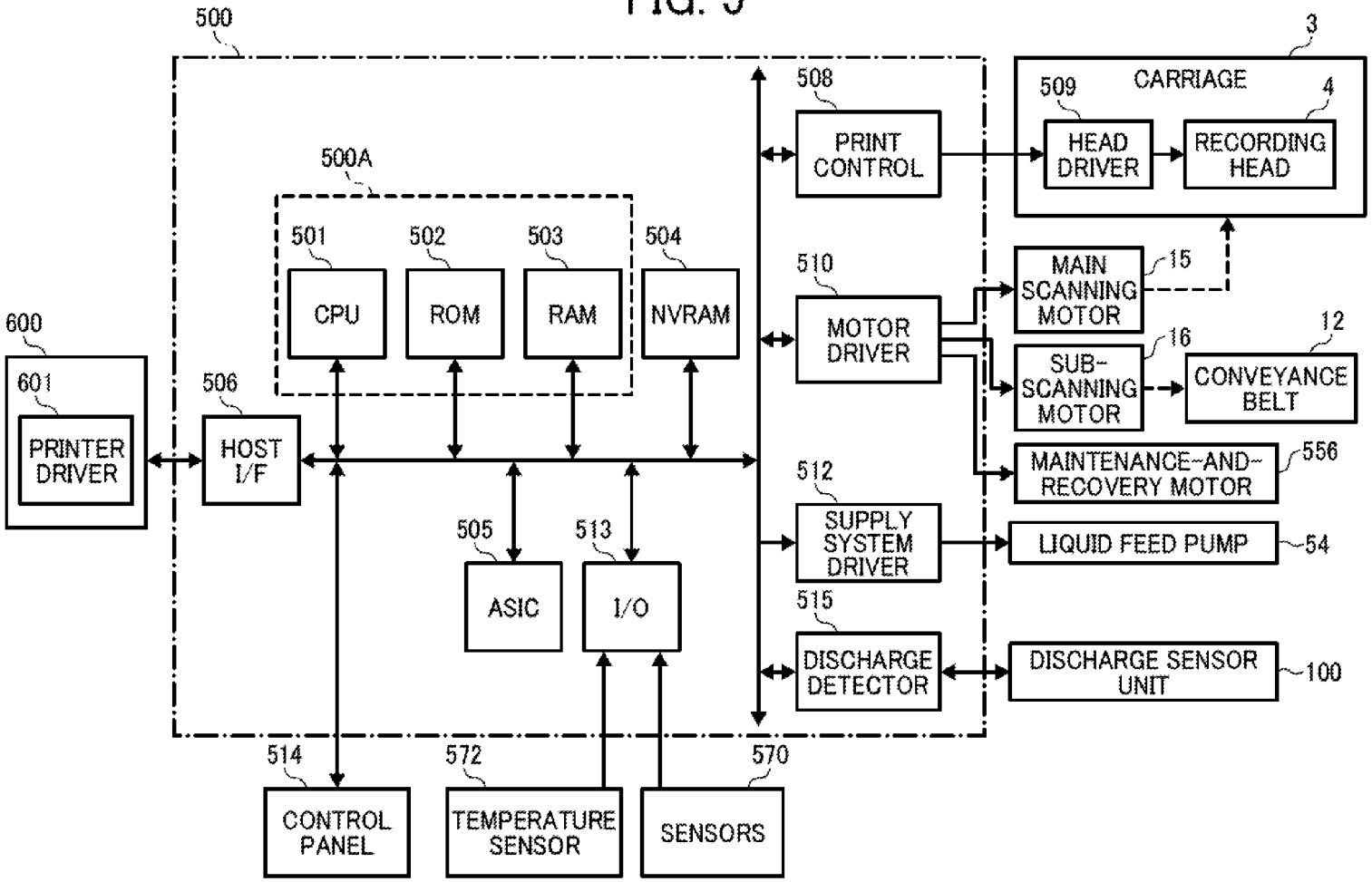
FIG. 5 is a block diagram of an outline of a controller of the image forming apparatus.

Next, an outline of a controller of the image forming apparatus 1000 is described with reference to FIG. 5. FIG. 5 is a block diagram of the controller of the image forming apparatus according to an embodiment of this disclosure.

In FIG. 5, the controller 500 includes a main controller 500A that includes a central processing unit (CPU) 501, a read-only memory (ROM) 502, and a random access memory (RAM) 503. The CPU 501 administrates the control of the entire image forming apparatus 1000. The ROM 502 stores fixed data, such as various programs including programs executed by the CPU 501, and the RAM 503 temporarily stores image data and other data.

The controller 500 further includes a non-volatile random access memory (NVRAM) 504 and an application-specific integrated circuit (ASIC) 505. The NVRAM 504 is a rewritable memory capable of retaining data even when the apparatus is powered off. The ASIC 505 processes various signals on image data, performs sorting or other image processing, and processes input and output signals to control the entire apparatus.

The controller 500 also includes a print control 508 and a head driver (driver integrated circuit) 509. The print control 508 includes a data transmitter and a driving signal generator to drive and control the recording heads 4. The head driver 509 drives the recording heads 4 mounted on the carriage 3.

The controller 500 further includes a motor driver 510 to the main scanning motor 15, the sub-scanning motor 16, and a maintenance-and-recovery motor 556. The main scanning motor 15 moves the carriage 3 for scanning, and the sub-scanning motor 16 circulates the conveyance belt 12. The maintenance-and-recovery motor 556 moves the suction cap 21, the moisture-retention cap 22, and the wiper 23 of the maintenance-and-recovery device 20 and drives the suction pump 27.

The controller 500 further includes a supply system driver 512 to drive the liquid feed pump 54. The controller 500 also includes a discharge detector 515 to control sensing of droplet discharge with the discharge sensor unit 100.

The controller 500 is connected to a control panel 514 to input and display information necessary to the image forming apparatus 1000.

The controller 500 includes a host interface (I/F) 506 to transmit and receive data and signals to and from a host 600, and receives data and signals by the host I/F 506 from a printer driver 601 of the host 600, such as an information processing device (e.g., personal computer), an image reading device, or an image pick-up device, via a cable or network.

The CPU 501 of the controller 500 reads and analyzes print data stored in a reception buffer of the I/F 506, performs desired image processing, data sorting, or other processing with the ASIC 505, and transfers image data from the print control 508 to the head driver 509.

The print control 508 transfers the above-described image data as serial data and outputs to the head driver 509, for example, transfer clock signals, latch signals, and control signals required for the transfer of image data and determination of the transfer.

In addition, the print control 508 includes the driving signal generator including, e.g., a digital/analog (D/A) converter (to perform digital/analog conversion on pattern data of driving pulses stored on the ROM 502), a voltage amplifier, and a current amplifier. The print control 508 outputs a driving signal containing one or more driving pulses from the driving signal generator to the head driver 509.

In accordance with serially-inputted image data corresponding to one line recorded by the recording heads 4, the head driver 509 selects driving pulses of a driving waveform transmitted from the print control 508 and applies the selected driving pulses to the pressure generator to drive the recording heads 4. At this time, by selecting a part or all of the driving pulses forming the driving waveform or a part or all of waveform elements forming a driving pulse, the recording heads 4 can selectively discharge dots of different sizes, e.g., large droplets, medium droplets, and small droplets.

An I/O unit 513 obtains information from various types of sensors 570 mounted on other devices in the image forming apparatus 1000, extracts information necessary for controlling the image forming apparatus 1000, and uses such information to perform various controls.

The main controller 500A also serves as a controller according to an embodiment of this disclosure to control a bubble purge operation to purge bubbles from the recording heads 4 according to the head temperature detected with the temperature sensor 572 and updating of a stored temperature and a threshold temperature used to determine whether the control of bubble purge operation is to be performed. A rewritable non-volatile random access memory, such as the NVRAM 504, serves as a storage device to store the stored temperature and the threshold temperature.

Note that, for the image forming apparatus in this embodiment, the temperature sensor 572 is mounted on the recording heads 4 to detect the head temperature. However, the configuration of temperature detection is not limited to such a configuration. For example, the temperature sensor 572 can be disposed at a position at which the environmental temperature in the apparatus body is detectable. The environmental temperature can be used as a head temperature (current temperature) described below.

Figure 6:
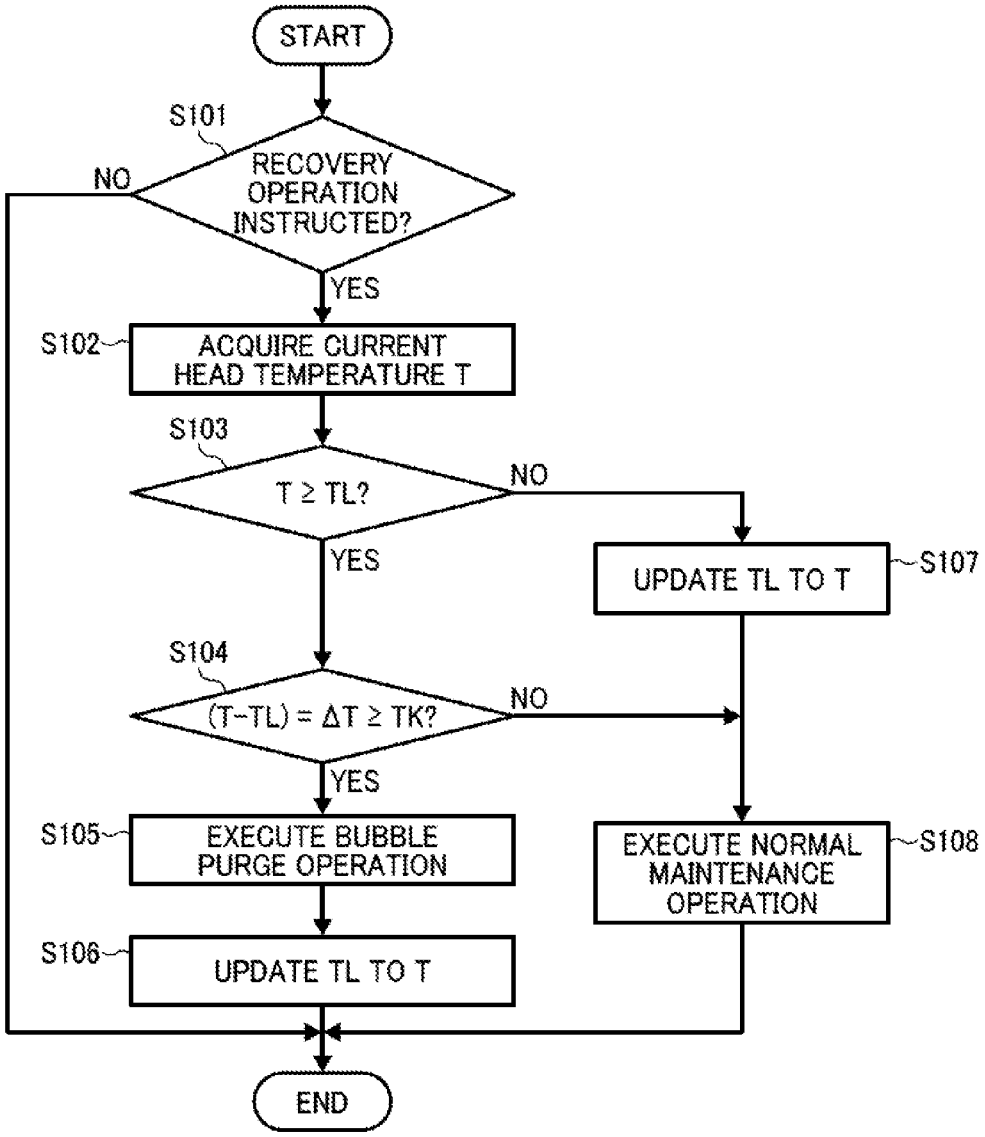
FIG. 6 is a flowchart illustrating control of a maintenance operation by a controller according to a first embodiment of the present disclosure.

Next, control of a maintenance operation by the controller according to the first embodiment of the present disclosure will be described with reference to a flowchart of FIG. 6.

First, at S101 the controller 500 determines whether a recovery operation instruction is received. The recovery operation instruction is input by a user using the control panel 514 or is given by the host 600. In addition, the recovery operation instruction is given when non-discharge is detected by the discharge detector 515 using the discharge sensor unit 100. In addition, the recovery operation instruction is given at predetermined timing, for example, a predefined time interval and is given when an unused time period is equal to or more than a predetermined time period.

Here, when the recovery operation instruction is received (YES at S101), at S102 a current temperature T of the recording head 4 is detected and acquired with the temperature sensor 572.

At S103, the controller 500 determines whether the current temperature T detected and acquired with the temperature sensor 572 is equal to or higher than a stored temperature TL stored in the NVRAM 504 ($T \geq TL$). The stored temperature TL is a lowest head temperature detected (acquired) after execution of a most recent bubble purge operation, as described later.

At this time, when the current temperature T is equal to or higher than the stored temperature TL (YES at S103), at S104 the controller 500 determines whether a deviation $\Delta T$ of the current temperature T and the stored temperature TL is more than a predefined threshold value TK ($(T-TL) = \Delta T > TK$).

That is, an amount of gas dissolved in a liquid increases when the head temperature decreases and decreases when the head temperature increases. Therefore, if the current head temperature T increases with respect to the lowest head temperature detected (acquired) after the execution of the most recent bubble purge operation and a variation (deviation $\Delta T$) thereof is more than the threshold value TK, the dissolved gas appears as bubbles.

Accordingly, the deviation $\Delta T$ of the current temperature T and the stored temperature TL to be the lowest head temperature detected (acquired) after the execution of the most recent bubble purge operation is compared with the threshold value TK, so that it can be determined whether the bubbles are generated in the head.

Therefore, when the deviation $\Delta T$ of the current temperature T and the stored temperature TL is equal to or more than the threshold value TK ($\Delta T \geq TK$) (YES at S104), at S105 the controller 500 executes control to execute the bubble purge operation (bubble-purge maintenance operation).

At S106, the controller 500 replaces (updates) the stored temperature TL with the current temperature T detected and acquired before the execution of the bubble purge operation ($TL=T$).

Alternatively, when the deviation $\Delta T$ of the current temperature T and the stored temperature TL is less than the threshold value TK ($\Delta T < TK$) (NO at S104), at S108 the controller 500 executes a normal maintenance operation.

When the detected and acquired current temperature T is less than the stored temperature TL ($T < TL$) (NO at S103), at S107 the controller 500 replaces (updates) the stored temperature TL with the detected and acquired current temperature T ($TL=T$). At S108, the controller 500 executes the normal maintenance operation.

Here, the bubble purge operation (bubble-purge maintenance operation) is a recovery operation stronger than the normal maintenance operation.

For example, in the maintenance operation, the suction pump 27 is driven in a state in which the nozzle surface of the recording head 4 is capped by the suction cap 21 and the liquid is sucked and purged from the nozzle 4*n* of the recording head 4 (nozzle suction). In the nozzle suction, a suction time in the bubble-purge maintenance operation is longer than a suction time in the normal maintenance operation.

In addition, when a head tank enabling pressurizing and feeding of a liquid is used as the head tank 5, in the bubble-purge maintenance operation, in addition to the nozzle suction, a choke valve is disposed between the head tank and the liquid feed pump 54, the choke valve is opened in a state in which the liquid is pressurized by the liquid feed pump 54, and the liquid can be pressurized and fed to the recording head.

Figure 7:
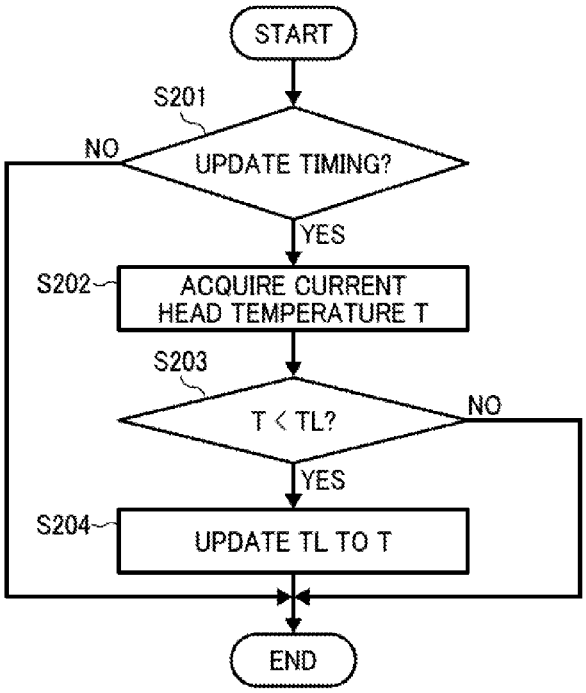
FIG. 7 is a flowchart illustrating a stored temperature updating process according to the first embodiment.

Next, a stored temperature updating process according to the first embodiment will be described with reference to a flowchart of FIG. 7.

At S201, the controller 500 determines whether timing is temperature information acquisition timing (updating timing) when temperature information is acquired by the temperature sensor 572. The temperature information acquisition timing can be generated whenever a predetermined time elapses, when an image is formed, and when the recovery operation by the maintenance-and-recovery device 20 is executed.

In addition, when the timing is the temperature information acquisition timing (YES at S201), at S202 the current head temperature T is acquired with the temperature sensor 572. At S203, the controller 500 determines whether the acquired current temperature T is lower than the stored temperature TL stored and retained in the memory ($T < TL$).

At this time, when the acquired current temperature T is lower than the stored temperature TL ($T < TL$) (YES at S203), at S204 the controller 500 replaces (updates) the stored temperature TL with the acquired temperature T ($TL=T$).

Meanwhile, when the acquired current temperature T is not lower than the stored temperature TL ($T < TL$) (NO at S203), the stored temperature TL is maintained.

As a result, the stored temperature TL becoming a reference when the deviation $\Delta T$ compared with the threshold value TK to determine whether or not to execute the bubble purge operation is calculated is stored and retained as a lowest head temperature (lowest temperature) during a period from timing after the previous bubble purge operation to newest temperature information acquisition timing.

Figure 8:
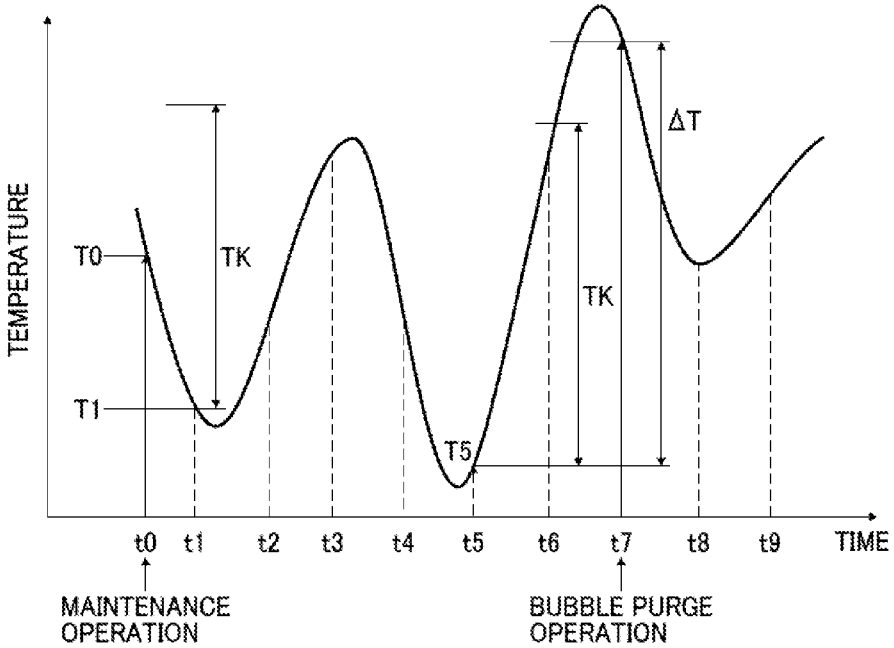
FIG. 8 is a diagram illustrating change of a head temperature and updating of a setting temperature to describe a specific example of the first embodiment.

Next, a specific example of this embodiment will be described with reference to FIG. 8. FIG. 8 is a diagram illustrating a change of the head temperature and updating of the setting temperature.

Here, the maintenance operation is executed at a time t0 and the maintenance operation is executed at a time t7. The current temperatures (acquired temperatures) T when the head temperature is acquired at times t0 to t9 are set as temperatures T0 to T9, respectively.

First, the temperature T0 when the maintenance operation is executed at the time t0 is set as the stored temperature TL.

Then, because the temperature T1 acquired at the time t1 is lower than the temperature T0 to be the stored temperature TL until the time t1 (T0>T1), the temperature T1 is updated with the stored temperature TL=T1. Then, because the temperature T2 acquired at the time t2 is higher than the temperature T1 to be the stored temperature TL until the time t2 (T1<T2), the stored temperature TL=T1 is maintained. Likewise, because the temperature T3 acquired at the time t3 and the temperature T4 acquired at the time t4 is higher than the temperature T1 to be the stored temperature TL (T1<T3 and T1<T4), the stored temperature TL=T1 is maintained.

Next, because the temperature T5 acquired at the time t5 is lower than the temperature T1 to be the stored temperature TL until the time t5 (T1>T5), the temperature T5 is updated with the stored temperature TL=T5. Likewise, because the temperature T6 acquired at the time t6 is higher than the temperature T5 to be the stored temperature TL (T5<T6), the stored temperature TL=T5 is maintained.

In addition, the recovery operation instruction is given at the time t7, so that the maintenance operation is executed.

Because the deviation ΔT of the temperature T7 at the time t7 and the stored temperature TL=T5 is larger than the predefined threshold value TK, the bubble purge operation (bubble-purge maintenance operation) is executed. In addition, after the bubble purge operation ends, the stored temperature TL is updated with the temperature T7.

Then, because the temperature T8 acquired at the time t8 is lower than the temperature T7 to be the stored temperature TL until the time t8 (T7>T8), the temperature T8 is updated with the stored temperature TL=T8. Then, because the temperature T9 acquired at the time t9 is higher than the temperature T8 to be the stored temperature TL (T8<T9), the stored temperature TL=T8 is maintained.

In this way, the stored temperature TL becoming the reference to determine whether or not to execute the bubble purge operation is updated with the acquired temperature T when the acquired current head temperature (acquired temperature) T becomes lower than the stored temperature TL stored and retained in the memory.

In addition, when a temperature rise (deviation ΔT) from the stored temperature TL is more than the threshold value TK, the dissolved gas becomes bubbles. For this reason, the bubble purge operation is executed, so that the discharge failure is suppressed from occurring.

As such, the bubble purge operation is executed when the bubbles appear in the liquid discharge head. Therefore, the bubbles can be efficiently purged.

Figure 9:
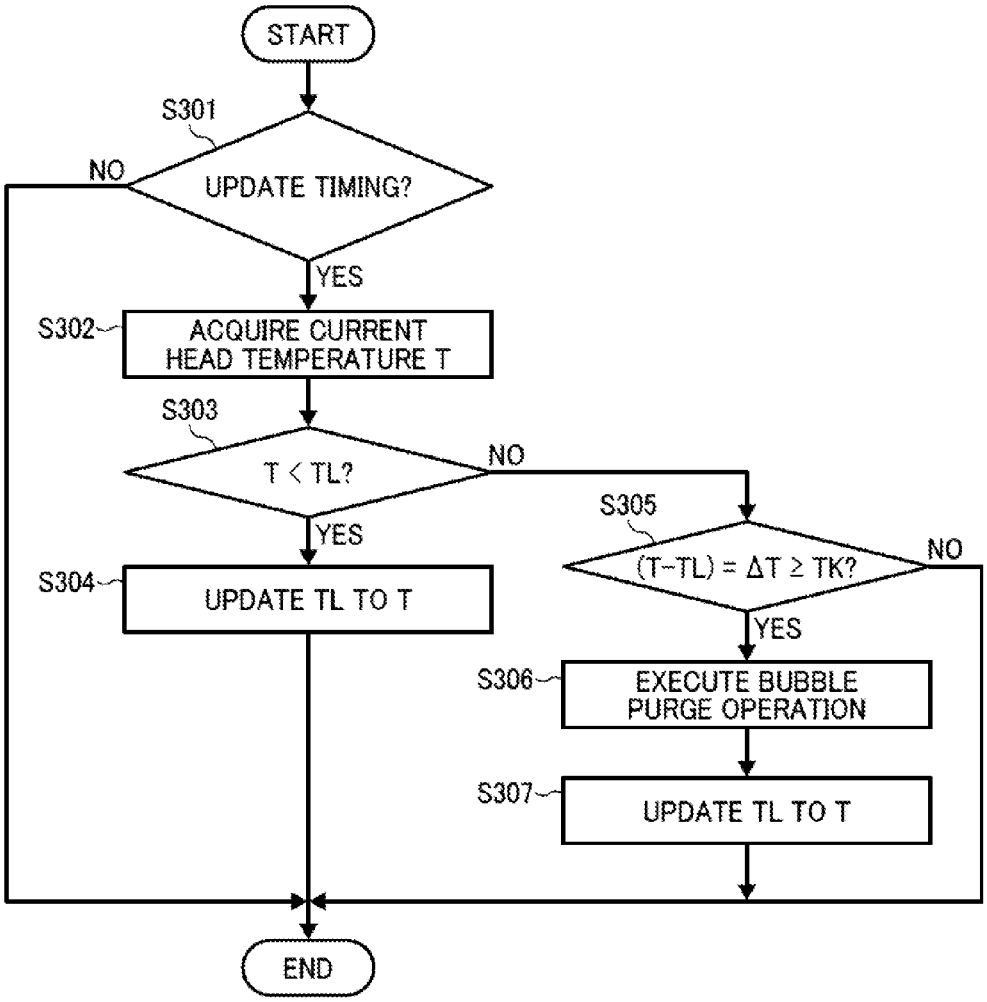
FIG. 9 is a flowchart illustrating a stored temperature updating process according to a second embodiment of the present disclosure.

Next, a stored temperature updating process according to a second embodiment of the present disclosure will be described with reference to a flowchart of FIG. 9.

In this embodiment, at the time of executing the stored temperature updating process (updating timing: current temperature acquisition timing), when a deviation ΔT of a stored temperature before updating and a current temperature is equal to or more than a threshold value TK, a bubble purge operation is executed.

That is, similar to the first embodiment, at S301 the controller 500 determines whether timing is temperature information acquisition timing (updating timing) when temperature information is acquired by a temperature sensor 572.

In addition, when the timing is the temperature information acquisition timing (YES at S301), at S302 a current temperature T is acquired by the temperature sensor 572.

At S303, the controller 500 determines whether the acquired current temperature T is lower than a stored temperature TL stored and retained in a memory (T<TL).

At this time, when the acquired current temperature T is lower than the stored temperature TL (T<TL) (YES at S303), at S304 the controller 500 replaces (updates) the stored temperature TL with the acquired temperature T (TL=T).

Alternatively, when the acquired current temperature T is not lower than the stored temperature TL (T<TL), that is, the current temperature T is equal to or higher than the stored temperature TL (T≥TL) (NO at S303), at S305 the controller 500 determines whether a deviation ΔT of the current temperature T and the stored temperature TL is equal to or more than the threshold value TK ((T−T1)ΔT>TK).

At this time, when the deviation ΔT of the current temperature T and the stored temperature TL is equal to or more than the threshold value TK (ΔT>TK) (NO at S305), at S306 the controller 500 executes a bubble purge operation (bubble-purge maintenance operation).

At S307, the controller 500 replaces (updates) the stored temperature TL with the current temperature T detected and acquired before execution of the bubble purge operation (TL=T).

As a result, even in the case in which there is no recovery operation instruction such as an instruction from a user and non-discharge detection, when a variation (ΔT) of a head temperature is equal to or more than the threshold value TK at the updating timing, the bubble purge operation can be executed and the bubbles can be quickly purged.

Figure 10:
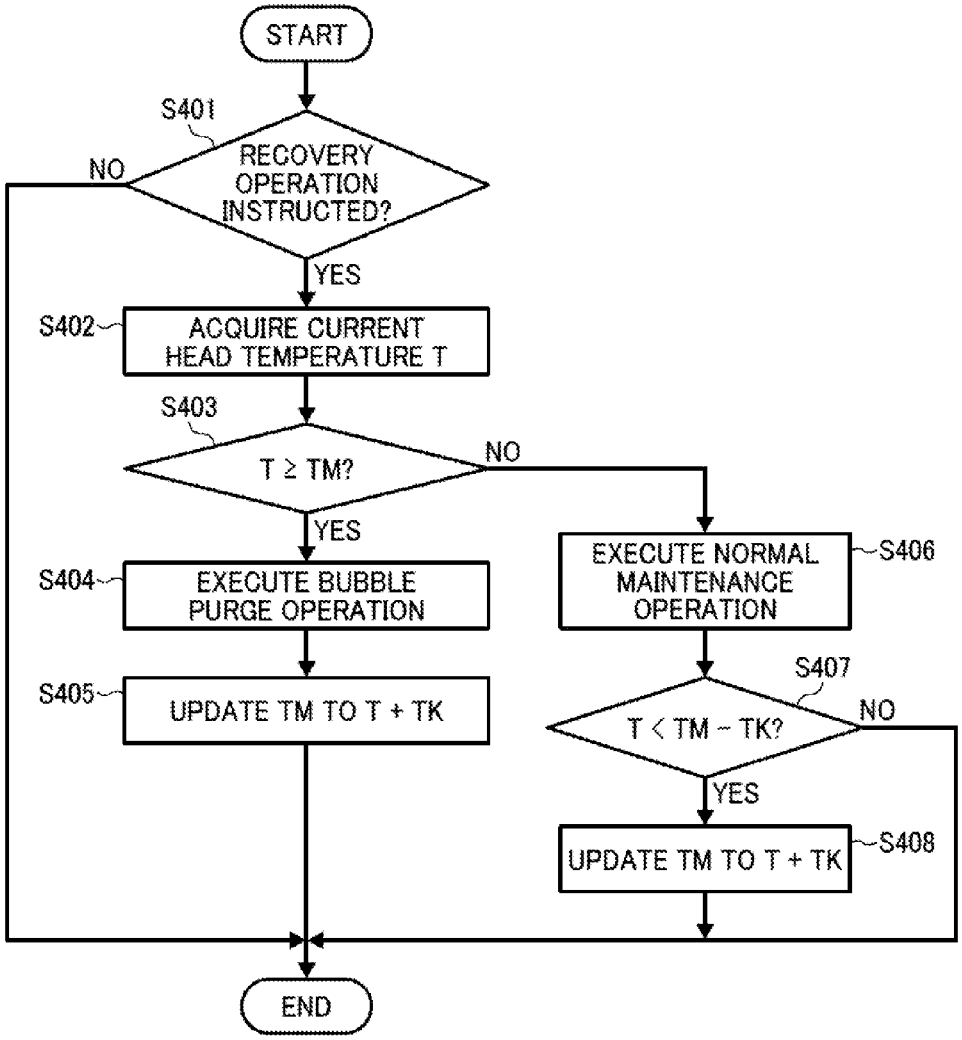
FIG. 10 is a flowchart illustrating control of a maintenance operation by a controller according to a third embodiment of the present disclosure.

Next, control of a maintenance operation according to a third embodiment of the present disclosure will be described with reference to a flowchart of FIG. 10.

At S401, the controller 500 determines whether a recovery operation instruction is received. The recovery operation instruction is given by the same method as the first embodiment.

Here, when there is the recovery operation instruction (YES at S401), at S402 a current temperature T of a recording head 4 is detected and acquired with a temperature sensor 572.

At S403, the controller 500 determines whether the detected and acquired current temperature T is equal to or higher than a threshold temperature TM stored and retained in a rewritable non-volatile memory (NVRAM) 504 (T≥TM). The threshold temperature TM is a temperature obtained by adding the threshold value TK (in this embodiment, referred to as a "predetermined temperature TK") according to the first embodiment to a lowest head temperature detected (acquired) after execution of a most recent bubble purge operation, as described later.

That is, as described above, an amount of gas dissolved in a liquid increases when the head temperature decreases and decreases when the head temperature increases. Therefore, if the current head temperature T increases with respect to the lowest head temperature detected (acquired) after the execution of the most recent bubble purge operation and a variation (deviation ΔT) thereof is more than the predetermined temperature TK, the dissolved gas appears as bubbles.

Accordingly, the temperature obtained by adding the predetermined temperature TK to the lowest head temperature detected (acquired) after the execution of the most recent bubble purge operation is retained as the threshold temperature TM and the current temperature T is compared with the retained threshold temperature TM, so that it can be determined whether the bubbles are generated in a head.

Therefore, when the current temperature T is equal to or higher than the threshold temperature TM (T≥TM) (YES at S403), at S404 the controller 500 executes the bubble purge operation (bubble-purge maintenance operation).

At S405, the controller 500 replaces (updates) the threshold temperature TM with the temperature obtained by adding the predetermined temperature TK to the current temperature T detected and acquired before the execution of the bubble purge operation (TM=T+TK).

When the detected and acquired current temperature T is lower than the threshold temperature TM (T<TM), at S406 the controller 500 executes a normal maintenance operation.

At S407, the controller 500 determines whether the current temperature T is lower than a temperature obtained by subtracting the predetermined temperature TK from the threshold temperature TM (T<TM−TK). That is, the controller 500 determines whether the temperature obtained by adding the predetermined temperature TK to the current temperature T is equal to or lower than the threshold temperature TM (T+TK<TM).

In addition, when the current temperature T is lower than the temperature obtained by subtracting the predetermined temperature TK from the threshold temperature TM (T<TM−TK) (YES at S407), at S408 the controller 500 replaces (updates) the threshold temperature TM with the temperature obtained by adding the predetermined temperature TK to the detected and acquired current temperature T (TM=T+TK).

As a result, at the time of executing the normal maintenance operation, when the current temperature T is lower than the lowest head temperature, the threshold temperature TM is updated with a low temperature.

Figure 11:
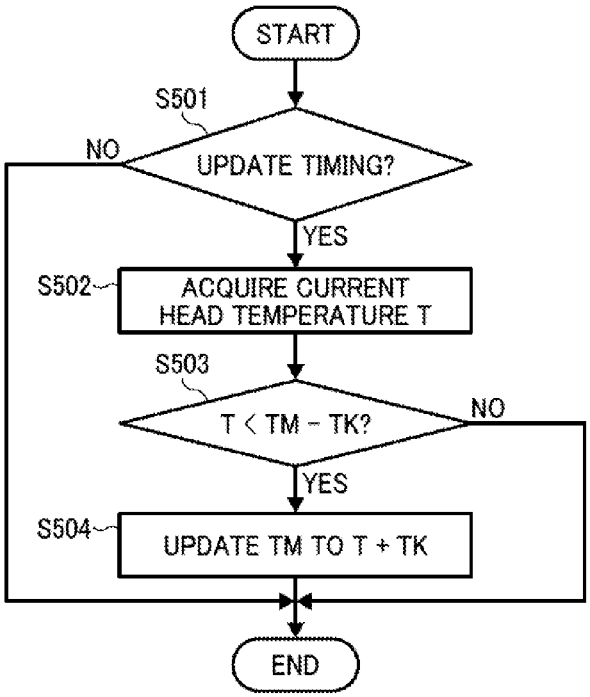
FIG. 11 is a flowchart illustrating a threshold temperature updating process according to the third embodiment.

Next, a threshold temperature updating process according to the third embodiment will be described with reference to a flowchart of FIG. 11.

At S501, the controller 500 determines whether timing is temperature information acquisition timing (updating timing) when temperature information is acquired by the temperature sensor 572. The temperature information acquisition timing is the same timing as the first embodiment.

In addition, when the timing is the temperature information acquisition timing (YES at S501), at S502 the current temperature T is acquired with the temperature sensor 572.

At S503, the controller 500 determines whether the current temperature T is lower than the temperature obtained by subtracting the predetermined temperature TK from the threshold temperature TM (T<TM−TK). That is, it is determined whether the temperature obtained by adding the predetermined temperature TK to the current temperature T is equal to or lower than the threshold temperature TM (T+TK<TM).

In addition, when the current temperature T is lower than the temperature obtained by subtracting the predetermined temperature TK from the threshold temperature TM (T<TM−TK) (YES at S503), the controller 500 replaces (updates) the threshold temperature TM with the temperature obtained by adding the predetermined temperature TK to the detected and acquired current temperature T (TM=T+TK).

As a result, the threshold temperature TM becoming a reference to determine whether or not to execute the bubble purge operation is stored as a temperature obtained by adding the predetermined temperature TK to a lowest head temperature (lowest temperature: lowest temperature TL according to the first embodiment) during a period from timing after the previous bubble purge operation to newest temperature information acquisition timing.

Figure 12:
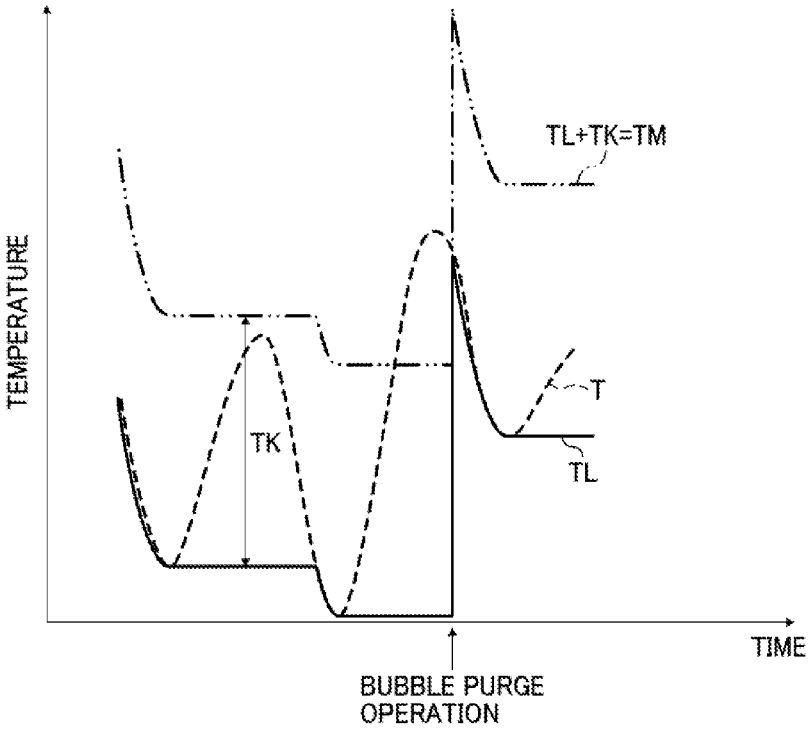
FIG. 12 is a diagram illustrating a change of a head temperature and updating of a setting temperature to describe a specific example of the third embodiment.

Next, a specific example of this embodiment will be described with reference to FIG. 12. FIG. 12 is a diagram illustrating a change of a head temperature and updating of a setting temperature.

As seen from FIG. 12, when the current temperature T decreases, the threshold temperature TM to be a bubble purge operation execution threshold temperature decreases according to a variation of the current temperature. That is, the lowest temperature TL becomes the lowest head temperature after the execution of the previous bubble purge operation.

In addition, if the current temperature T becomes equal to or higher than the threshold temperature TM and the bubble purge operation is executed, the threshold temperature TM is updated with the temperature obtained by adding the predetermined temperature TK to the current temperature when the bubble purge operation is executed.

That is, in the first embodiment, the stored temperature TL becoming a reference to calculate the deviation ΔT with the current temperature T compared with the threshold value TK is updated with the low temperature and is stored and retained. However, in the third embodiment, the threshold temperature TM compared with the current temperature T is updated with the low temperature and is stored and retained, different from the first embodiment.

Figure 13:
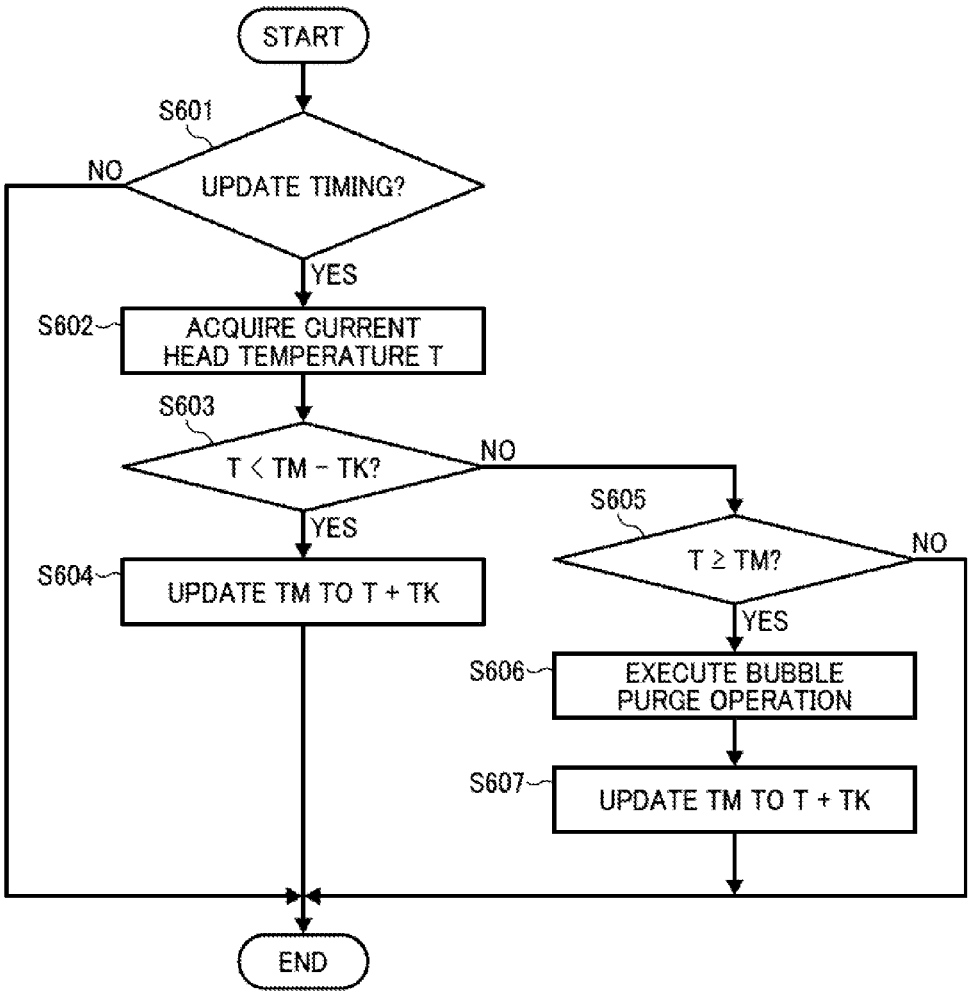
FIG. 13 is a flowchart illustrating a threshold temperature updating process according to a fourth embodiment of the present disclosure.

Next, a threshold temperature updating process according to a fourth embodiment of the present disclosure will be described with reference to a flowchart of FIG. 13.

In this embodiment, at the time of executing the threshold temperature updating process, when a current temperature T is equal to or higher than a threshold temperature TM, a bubble purge operation is executed.

That is, at S601 the controller 500 determines whether timing is temperature information acquisition timing (updating timing) when temperature information is acquired by a temperature sensor 572.

In addition, when the timing is the temperature information acquisition timing (YES at S601), at S602 the current temperature T is acquired with the temperature sensor 572.

At S603, the controller 500 determines whether the current temperature T is lower than a temperature obtained by subtracting a predetermined temperature TK from a threshold temperature TM (T<TM−TK). That is, it is determined whether a temperature obtained by adding the predetermined temperature TK to the current temperature T is equal to or lower than the threshold temperature TM (T+TK<TM).

In addition, when the current temperature T is lower than the temperature obtained by subtracting the predetermined temperature TK from the threshold temperature TM (T<TM−TK) (YES at S603), at S604 the controller 500 replaces (updates) the threshold temperature TM with the temperature obtained by adding the predetermined temperature TK to the detected and acquired current temperature T (TM=T+TK).

Alternatively, when the current temperature T is not lower than the temperature obtained by subtracting the predetermined temperature TK from the threshold temperature TM (T≥TM−TK) (NO at S603), at S605 the controller 500 determines whether the acquired current temperature (acquired temperature) T is equal to or higher than the threshold temperature TM stored and retained in a memory (T≥TM).

At this time, when the acquired current temperature (acquired temperature) T is equal to or higher than the threshold temperature TM (T≥TM) (YES at S605), at S606 the controller 500 executes a bubble purge operation (bubble-purge maintenance operation).

At S607, the controller 500 replaces (updates) the threshold temperature TM with a temperature obtained by adding the predetermined temperature TK to the current temperature T detected and acquired before the execution of the bubble purge operation (TM=T+TK).

As a result, even in the case in which there is no recovery operation instruction such as an instruction from a user and non-discharge detection, when a head temperature is equal to or higher than the threshold value TM at the updating timing, the bubble purge operation can be executed and the bubbles can be quickly purged.

The above-described embodiments of the present disclosure are described with reference to the drawings. However, the present invention are not limited to the above-described embodiments and numerous additional modifications and variations are possible within the scope of the above teachings.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another. The terms "image formation", "recording", "printing", and "image printing" are used herein as synonyms for one another.

The term "image forming apparatus" refers to an apparatus that discharges liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image. The term "image forming apparatus" includes both serial-type image forming apparatus and line-type image forming apparatus. The term "image forming apparatus" is not limited to a printer and may be, for example, a copier, a facsimile, a plotter, or a multifunctional periphery having at least one of the foregoing capabilities.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a liquid discharge head to discharge a droplet;

a temperature detector to detect a temperature of the liquid discharge head;

a memory to store the temperature of the liquid discharge head detected with the temperature detector; and a controller to control a bubble purge operation to purge bubbles in the liquid discharge head, wherein, when a current temperature of the liquid discharge head acquired by the temperature detector is higher than a stored temperature stored in the memory and a deviation of the acquired current temperature and the stored temperature is equal to or more than a predefined threshold value, the controller executes control to execute the bubble purge operation, and when the current temperature acquired by the temperature detector is lower than the stored temperature, the controller executes control to update the stored temperature stored and retained in the memory with the acquired current temperature.

2. The image forming apparatus according to claim 1, wherein, after the bubble purge operation is executed, the controller updates the stored temperature with the current temperature acquired before the bubble purge operation is executed.

3. The image forming apparatus according to claim 1, wherein, when a recovery operation of the liquid discharge head is instructed, the controller determines whether the bubble purge operation is to be executed.

4. The image forming apparatus according to claim 1, further comprising:

a discharge detector to detect a discharge state of the liquid discharge head, wherein, when the discharge detector detects non-discharge of the liquid discharge head, the controller determines whether the bubble purge operation is to be executed.

5. The image forming apparatus according to claim 1, wherein, after an image is formed, the controller acquires the current temperature of the liquid discharge head with the temperature detector.

6. The image forming apparatus according to claim 1, further comprising:

a recovery device to perform maintenance and recovery of the liquid discharge head, wherein, when the recovery device performs a recovery operation, the controller acquires the current temperature of the liquid discharge head with the temperature detector.

7. The image forming apparatus according to claim 1, wherein the controller acquires the current temperature with the temperature detector, each time a predetermined time period elapses.

8. An image forming apparatus comprising:

a liquid discharge head to discharge a droplet;

a temperature detector to detect a temperature of the liquid discharge head;

a memory to store the temperature of the liquid discharge head detected with the temperature detector; and a controller to control a bubble purge operation to purge bubbles in the liquid discharge head, wherein, when a current temperature acquired by the temperature detector is equal to or higher than a threshold temperature stored and retained in the memory, the controller executes control to execute the bubble purge operation and when the current temperature acquired by the temperature detector is a temperature lower than a predetermined temperature with respect to the threshold temperature, the controller executes control to update the threshold temperature stored and retained in the memory with a temperature obtained by adding the predetermined temperature to the acquired current temperature.

9. The image forming apparatus according to claim 8, wherein, after the bubble purge operation is executed, the controller updates the threshold temperature with a temperature obtained by adding the predetermined temperature to the current temperature acquired before the bubble purge operation is executed.

10. The image forming apparatus according to claim 8, wherein, when a recovery operation of the liquid discharge head is instructed, the controller determines whether the bubble purge operation is to be executed.

11. The image forming apparatus according to claim 8, further comprising:

a discharge detector to detect a discharge state of the liquid discharge head, wherein, when the discharge detector detects non-discharge of the liquid discharge head, the controller determines whether the bubble purge operation is to be executed.

12. The image forming apparatus according to claim 8, wherein, after an image is formed, the controller acquires the current temperature of the liquid discharge head with the temperature detector.

13. The image forming apparatus according to claim 8, further comprising:

a recovery device to perform maintenance and recovery of the liquid discharge head, wherein, when the recovery device performs a recovery operation, the controller acquires the current temperature of the liquid discharge head with the temperature detector.

14. The image forming apparatus according to claim 8, wherein the controller acquires the current temperature with the temperature detector, each time a predetermined time period elapses.

* * * * *